US006021766A

United States Patent [19]

Maeda et al.

[11] Patent Number: 6,021,766

[45] Date of Patent: Feb. 8, 2000

[54] BREATHER DEVICE FOR ENGINE

[75] Inventors: Takeshi Maeda; Tamotsu Momosaki, both of Wako, Japan

[73] Assignee: Honda Giken Kogyo Kabushiki Kaisha, Tokyo, Japan

[21] Appl. No.: 09/173,562

[22] Filed: Oct. 16, 1998

[30] Foreign Application Priority Data

Oct. 22, 1997 [JP] Japan ..... 9-289870

[51] Int. Cl.[7] ..... F01M 9/06; F01M 11/02

[52] U.S. Cl. ..... 123/573

[58] Field of Search ..... 123/572, 573, 123/574

[56] References Cited

U.S. PATENT DOCUMENTS

| | | | |
|---|---|---|---|
| 2,818,052 | 12/1957 | Trainer | 123/572 |
| 4,627,406 | 12/1986 | Namiki et al. | 123/572 |
| 4,922,881 | 5/1990 | Tamba et al. | 123/572 |
| 5,063,882 | 11/1991 | Koch et al. | 123/572 |
| 5,474,035 | 12/1995 | Ming et al. . | |

FOREIGN PATENT DOCUMENTS

| | | |
|---|---|---|
| 0 294 786 | 12/1988 | European Pat. Off. . |
| 0 454 512 A1 | 10/1991 | European Pat. Off. . |
| 0 779 412 A2 | 6/1997 | European Pat. Off. . |
| 0 835 987 A2 | 4/1998 | European Pat. Off. . |
| 2 755 725 | 5/1998 | France . |

*Primary Examiner*—Marguerite McMahon
*Attorney, Agent, or Firm*—Nikaido, Marmelstein, Murray & Oram LLP

[57] ABSTRACT

A breather device for an engine comprises a gas-liquid separation chamber communicating with the crankcase chamber through the one-way valve, a breather passage opening the gas-liquid separation chamber into an air cleaner, first and second oil suction holes arranged below and above an inner end of the breather passage opening to the gas-liquid separation chamber, and an oil passage communicating the first and second oil suction holes to an oil reservoir chamber having a pressure lower than that of the gas-liquid separation chamber. This construction enables the oil separated from the blow-by gas and liquefied in the gas-liquid separation chamber to be returned quickly to the oil reservoir chamber through the first or second oil suction holes, irrespective of whether the engine is in an normal upright position or an inverted position.

5 Claims, 12 Drawing Sheets

BREATHER DEVICE FOR ENGINE

BACKGROUND OF THE INVENTION

1. Field of the Invention

The present invention relates to a breather device for a hand-held type four-cycle engine that is used as a power source mainly for trimmers and chain saws.

1. Description of the Related Art

The breather device of an engine separates oil from a blow-by gas that has leaked from a combustion chamber into a crankcase chamber and returns the extracted oil to a oil reservoir chamber and at the same time feeds the gas to an intake system or releases it into the atmosphere. In the conventional breather device, when the engine is used in an inverted position, the oil separated from the blow-by gas in a gas-liquid separation chamber does not return to the oil reservoir chamber swiftly and may instead mix with the blow-by gas and get discharged into a breather passage.

SUMMARY OF THE INVENTION

The present invention has been accomplished to overcome the above problem and an object thereof is to provide a breather device for an engine that can quickly and always return the oil separated from the blow-by gas in the gas-liquid separation chamber to the oil reservoir chamber, irrespective of whether the engine is in a normal upright position or an inverted position.

To achieve the above object, the first feature of this invention is that the breather device for an engine comprises a gas-liquid separation chamber communicating with a crankcase chamber in an engine, a control valve installed in a communicating passage between the crankcase chamber and the gas-liquid separation chamber to pass positive pulsating pressures generated in the crankcase chamber, a breather passage to open the gas-liquid separation chamber to an intake system of the engine or to the atmosphere, first and second oil suction holes arranged below and above an inner end of the breather passage which opens into the gas-liquid separation chamber, and an oil passage to communicate the first and second oil suction holes to an oil reservoir chamber having a pressure lower than that of the gas-liquid separation chamber.

With the first feature, the first oil suction holes are situated lower than the inner end of the breather passage when the engine is held upright and, when the engine is held upside down, the second oil suction holes are situated below the inner end. Hence, the oil separated from the blow-by gas and liquefied in the gas-liquid separation chamber can be drawn through the first or second oil suction holes into the oil reservoir chamber, reliably assuring the return of oil and preventing the oil from mixing again with the blow-by gas flowing out into the breather passage, irrespective of whether the engine is in a normal upright position or an inverted position.

In addition to the above feature, this invention has a second feature that winding paths are formed between the inlet of the gas-liquid separation chamber and the breather passage.

With the second feature, the blow-by gas that has flowed into the gas-liquid separation chamber can be effectively separated into gas and liquid by the winding paths before the gas reaches the breather passage.

In addition to the first or second feature, this invention has a third feature that a suction chamber communicating with the oil passage is formed above the gas-liquid separation chamber with a separation wall therebetween, the separation wall is formed with suction tubes communicating with the suction chamber, the first oil suction holes formed at lower ends of the suction tubes are set close to a bottom wall of the gas-liquid separation chamber, and the second oil suction holes communicating the gas-liquid separation chamber and the suction chamber with each other are formed in the separation wall.

With the third feature, the first and second oil suction holes can easily be formed, enhancing the productivity.

In addition to the first, second or third feature, this invention has a fourth feature that a bottom wall of a valve operation chamber communicating with the crankcase chamber through the control valve is formed with small holes communicating with the oil reservoir chamber, and a ceiling portion of the valve operation chamber is formed with the gas-liquid separation chamber communicating with the valve operation chamber and also formed with third oil suction holes communicating with the oil passage.

With the fourth feature, the blow-by gas can be separated into gas and liquid also in the valve operation chamber before it enters the gas-liquid separation chamber. The oil separated and liquefied in the valve operation chamber can be returned to the oil reservoir chamber through the small holes when the engine is held upright and through the third oil suction holes when the engine is held upside down.

In addition to the fourth feature, this invention has a fifth feature that the valve operation chamber is formed with winding paths communicating the valve operation chamber to an inlet of the gas-liquid separation chamber.

With the fifth feature, the blow-by gas in the valve operation chamber can be effectively separated into gas and liquid by the winding paths even before it reaches the gas-liquid separation chamber.

These and other objects, features and advantages of this invention will become apparent from the following detailed description of a preferred embodiment in conjunction with the accompanying drawings.

DETAILED DESCRIPTION OF THE PREFERRED EMBODIMENT

Now, one embodiment of the present invention will be described by referring to the accompanying drawings.

Figure 1:
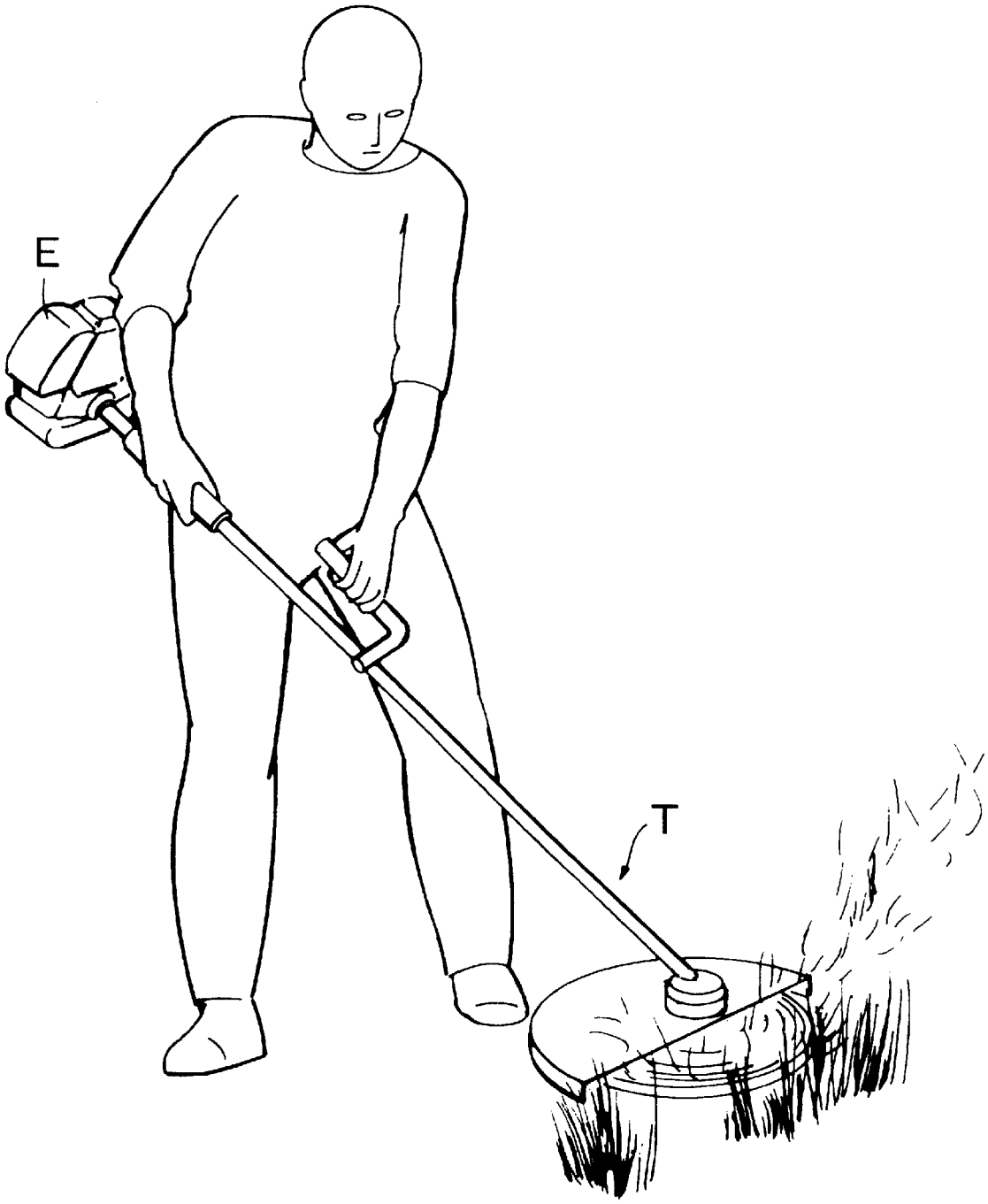
FIG. 1 is a perspective view showing one example use of a hand-held four-cycle engine having a breather device of the present invention.

As shown in FIG. 1, a hand-held type four-cycle engine E is mounted to a drive unit as a power source of a power trimmer T. During the operation of the power trimmer T, a cutter which is equipped in the power trimmer is directed in various directions according to an operation state of the power trimmer and the engine E is also held in a variety of positions, for example, it may be tilted greatly or held upside down.

Figure 2:
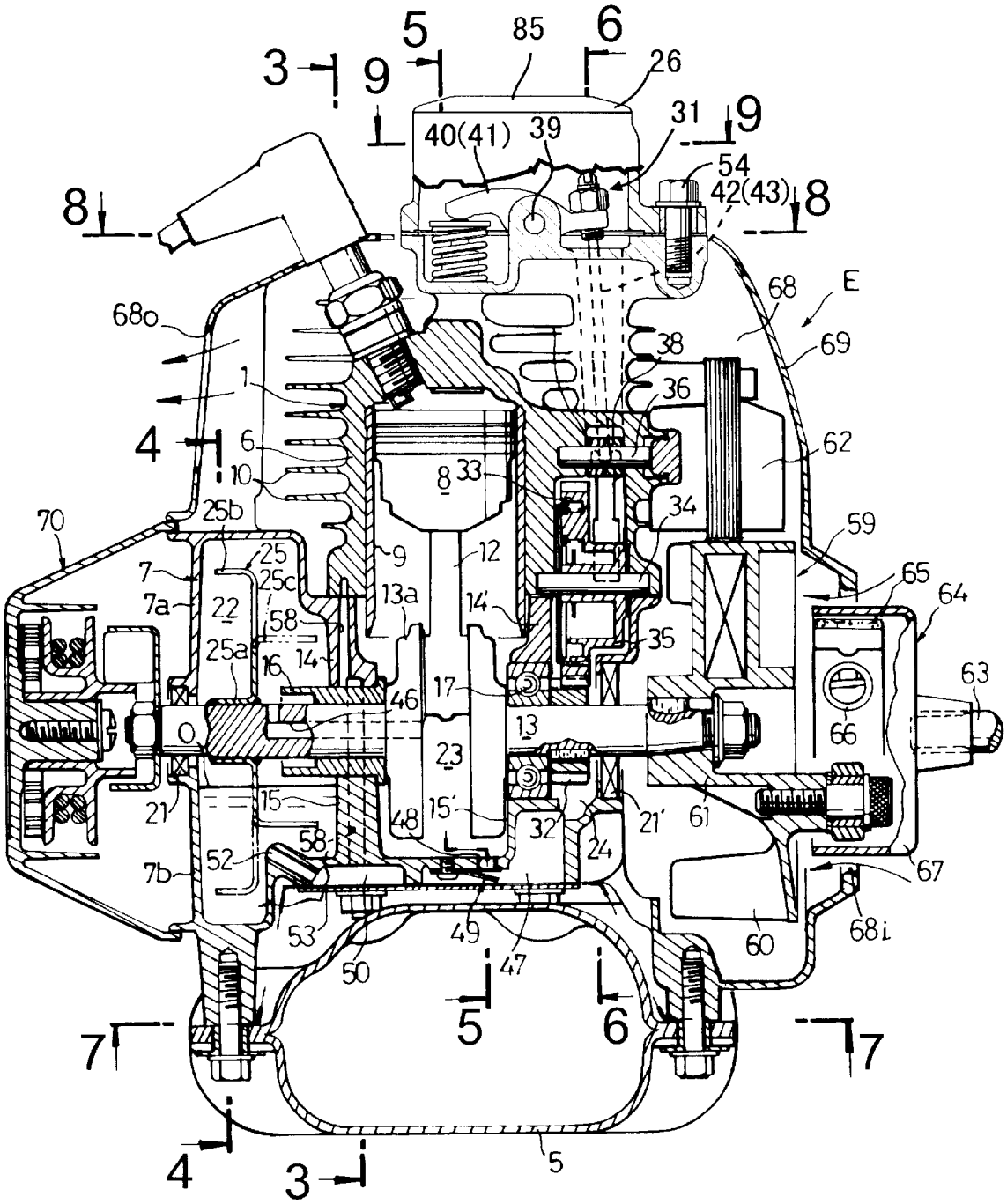
FIG. 2 is a front, vertical cross section of the four-cycle engine.
Figure 3:
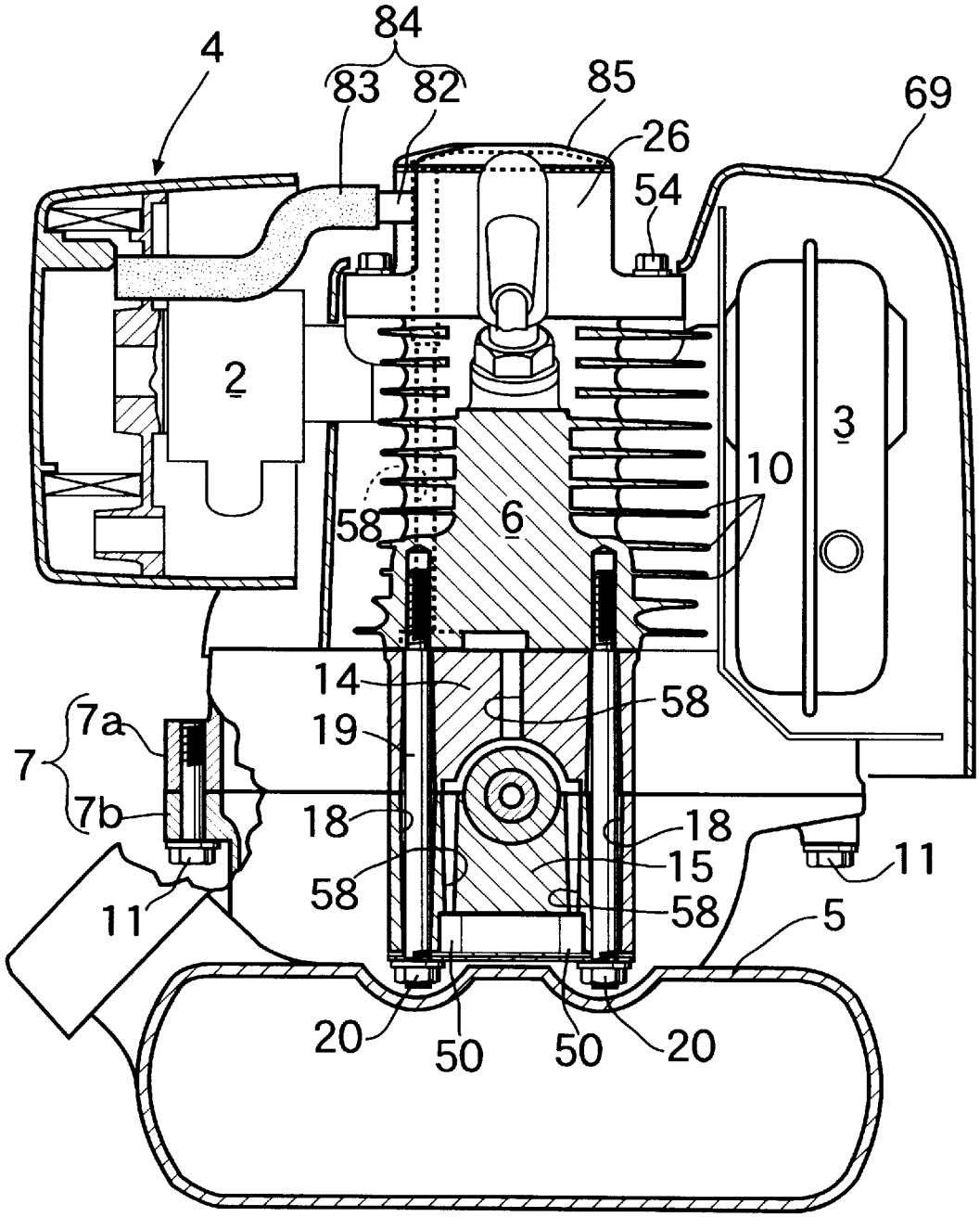
FIGS. 3 to 8 are cross sections taken along the lines 3—3 to 8—8 of FIG. 2.

In FIGS. 2 and 3, an engine body 1 of the engine E has a carburetor 2 and an exhaust muffler 3 at the front and rear portions thereof. An air cleaner 4 is installed at an inlet of an intake passage of the carburetor 2. At the bottom of the engine body 1 is mounted a fuel tank 5. The carburetor 2 has a diaphragm pump that utilizes pressure pulsations of a crankcase chamber described later to pump fuel from the fuel tank 5 and return excess fuel to the fuel tank 5, so that the fuel can be supplied to an intake port no matter which position the engine E assumes.

In FIGS. 2 and 3, the engine body 1 comprises a cylinder block 6 and a crankcase 7 joined to the lower end surface of the cylinder block 6. The cylinder block 6 has a single cylinder 9 accommodating a piston 8 at the center thereof and a number of cooling fins 10 of an outer circumference of the cylinder block 6.

The crankcase 7 has a pair of upper and lower crankcase halves 7*a*, 7*b* joined to each other by a plurality of bolts 11 arranged along the periphery of the crankcase halves. A crankshaft 13 connected to the piston 8 through a connecting rod 12 is supported between the crankcase halves 7*a*, 7*b* as follows.

The upper crankcase half 7*a* has a pair of left and right upper journal support walls 14, 14' formed integrally therewith and extending vertically down from a ceiling wall thereof. The lower crankcase half 7*b* has a pair of left and right lower journal support walls 15, 15'0 formed integrally therewith and rising from its bottom wall opposed to the upper journal support walls 14, 14'. The left journal portion of the crankshaft 13 is held between the upper and lower journal support walls 14, 15 on the left side of the crankcase 7 through a plain bearing 16. The right journal portion of the crankshaft 13 is held between the upper and lower journal support walls 14', 15' on the right side of the crankcase 7 through a ball bearing 17. The upper and lower journal support walls 14, 14' and 15, 15' are formed with a total of four parallelly arranged bolt holes 18 vertically piercing the crankcase 7 with the plane bearing 16 or ball bearing 17 interposed therebetween. Four stud bolts 19 passing through these bolt holes 18 are screwed into the lower end surface of the cylinder block 6. Nuts 20 are screwed over the lower ends of the stud bolts 19 projecting from the lower surface of the crankcase 7 to fasten the upper and lower journal support walls 14, 14' and 15, 15' with each other and also the cylinder block 6 and the crankcase 7 with each other.

This connecting structure does not interfere with the cooling fins 10 formed at the outer circumference of the cylinder block 6, so that the number and width of the cooling fins 10 can freely be selected, thereby sufficiently enhancing the air-cooling effect of the engine E. It can also increase the support rigidity for the crankshaft 13 of the crankcase 7.

Oil seals 21, 21' are attached to the portion where the crankshaft 13 passes through the end walls of the crankcase 7.

The interior of the crankcase 7 is divided by the upper and lower journal support walls 14, 14' and 15, 15' into an oil reservoir chamber 22 at the left, a crankcase chamber 23 at the center, and a valve operation chamber 24 at the right, as shown in FIG. 2. The crankcase chamber 23 accommodates a crank portion 13*a* of the crankshaft 13. The oil reservoir chamber 22 stores a predetermined amount of lubricating oil O, which is disturbed and splashed by an oil slinger 25 secured to the crankshaft 13.

Figure 4:
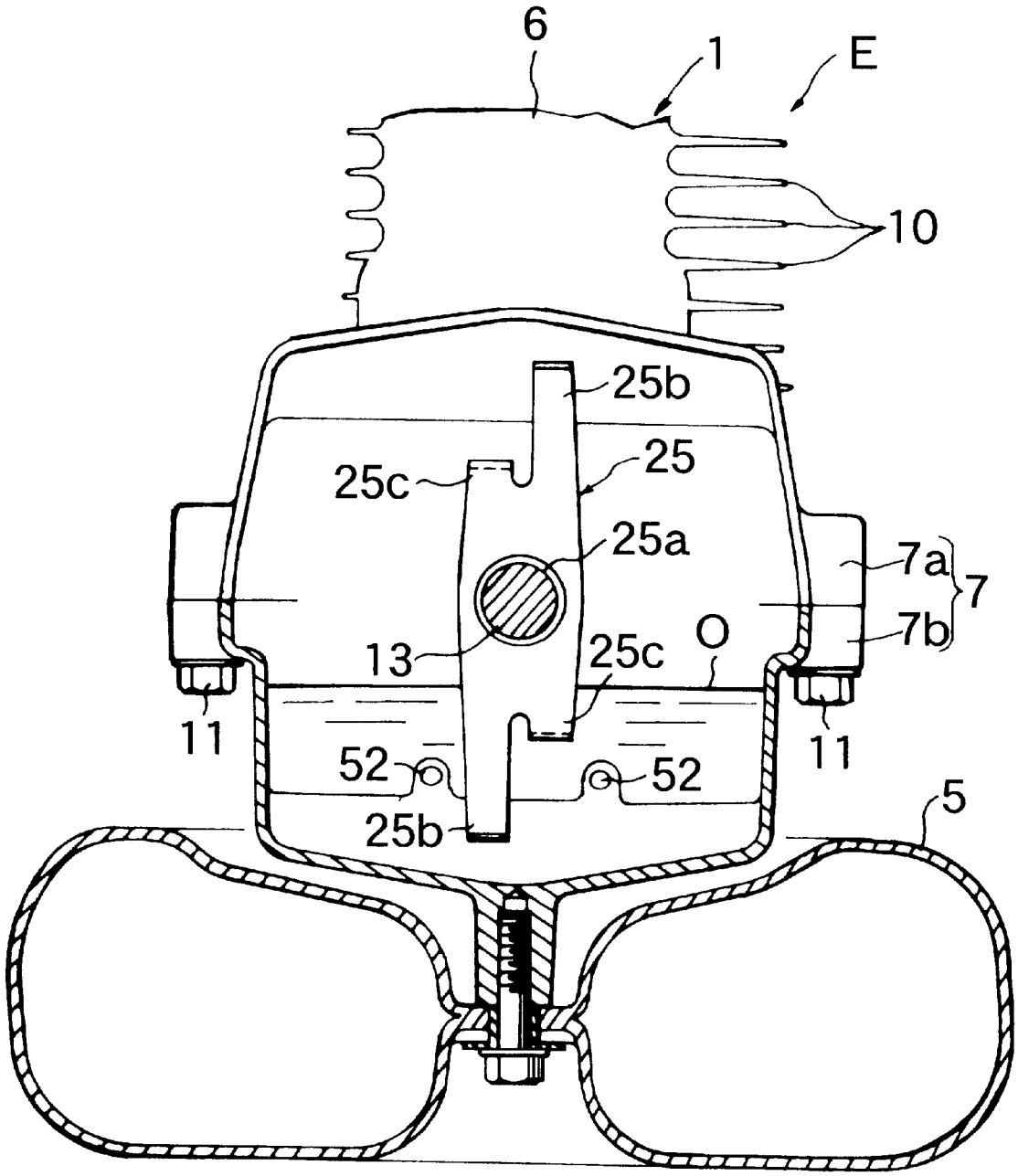

As shown in FIGS. 2 and 4, the oil slinger 25 comprises a boss 25*a* fitted over the crankshaft 13 and a plurality of long-arm blades 25*b* and short-arm blades 25*c* projecting from the outer periphery of the boss 25*a*, the front ends of the blades 25*b*, 25*c* being bent axially in opposite directions.

The oil slinger 25 of the above construction can agitate the oil in the oil reservoir chamber 22 by the rotating blades 25*b*, 25*c* to generate oil mist at all times whatever attitude the engine E assumes.

The valve operation chamber 24 extends through one side of the cylinder block 6 up to its head portion, and an upper part of the valve operation chamber 24 can be opened and closed by a head cover 26 of synthetic resin joined to the head of the cylinder block 6 by a bolt 54.

Figure 5:
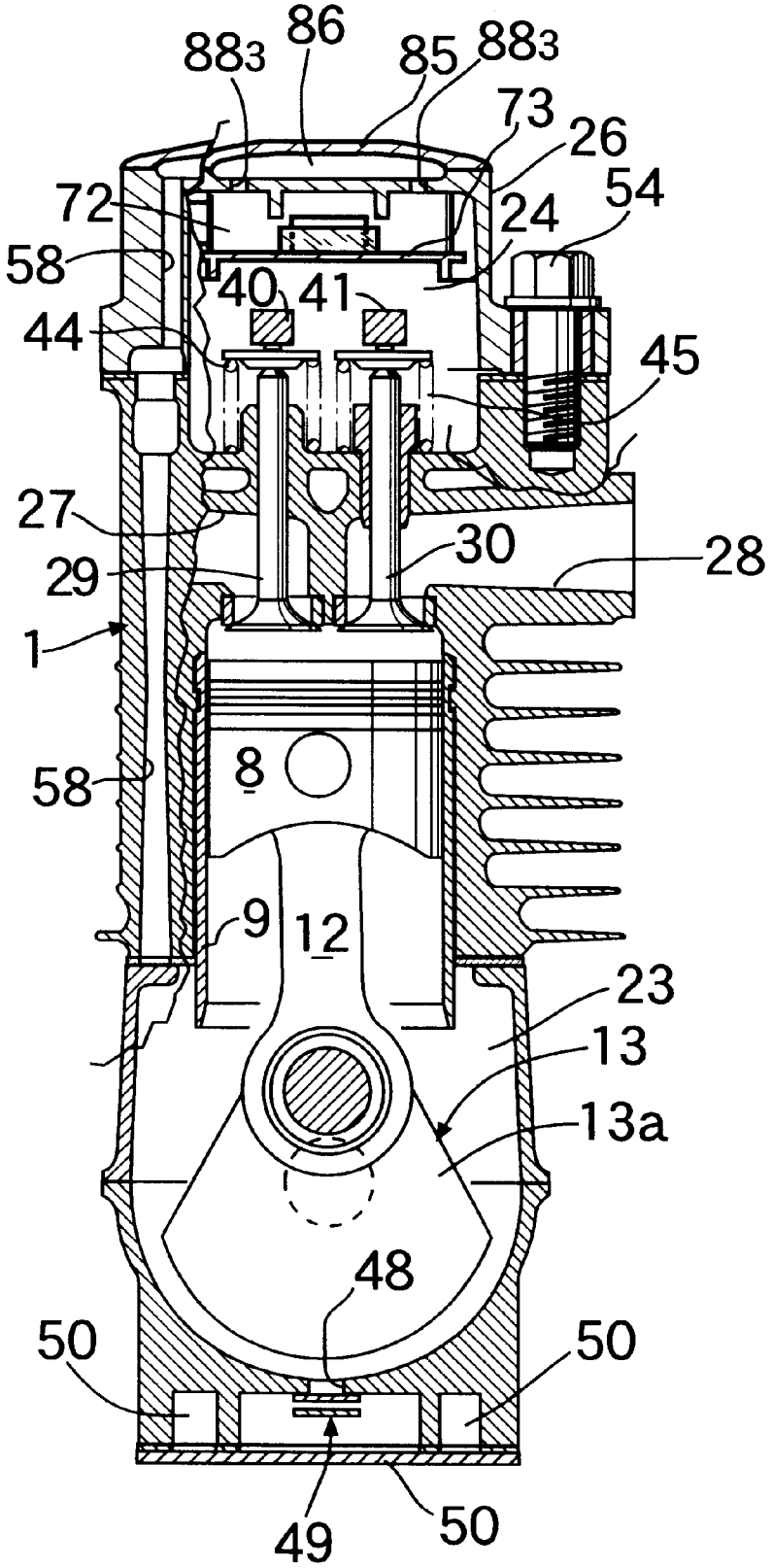

As shown in FIGS. 2 and 5, the head portion of the cylinder block 6 is formed with an intake and exhaust ports 27, 28 communicating with the carburetor 2 and the exhaust muffler 3 and is also provided with an intake and an exhaust valve 29, 30 that opens and closes the intake and exhaust port 27, 28 respectively. A valve operating device 31 for opening and closing the intake and exhaust valves 29, 30 is installed in the valve operation chamber 24.

Figure 6:
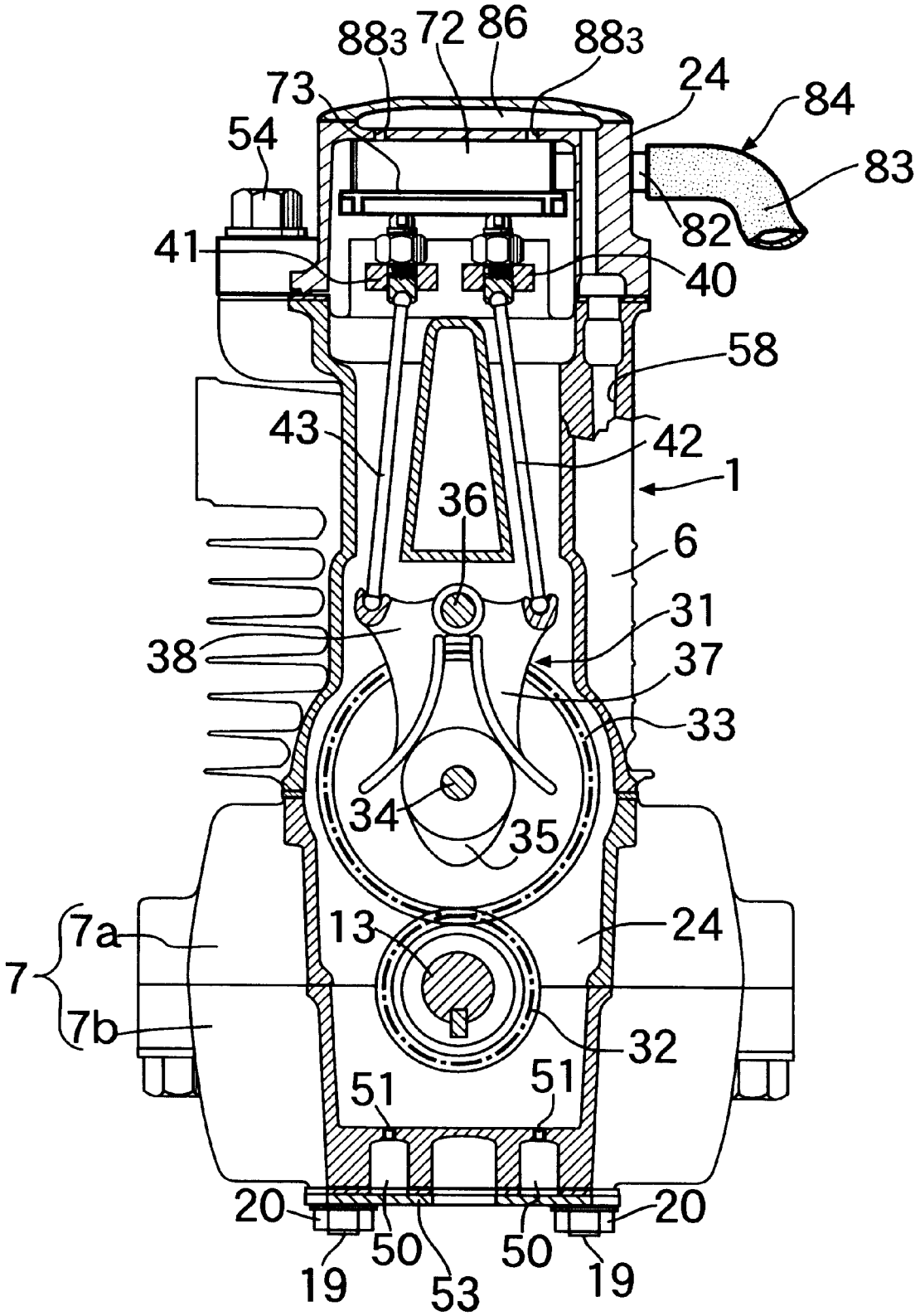
Figure 8:
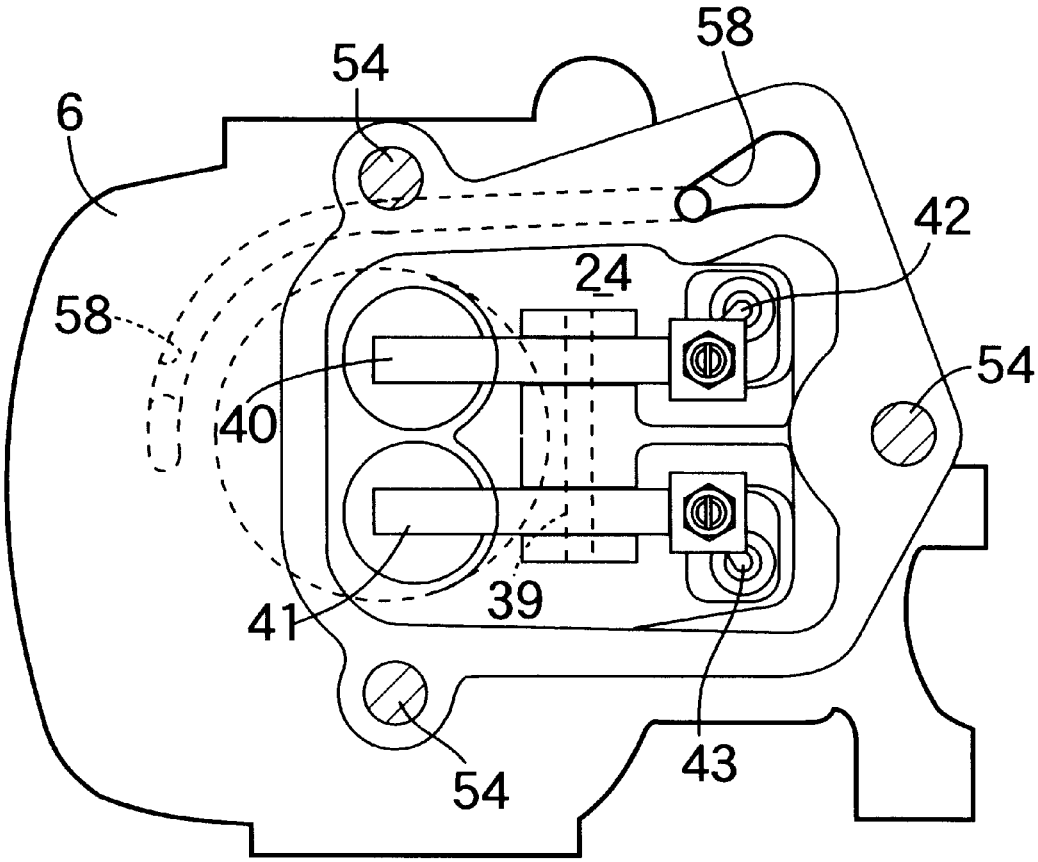
Figure 9:
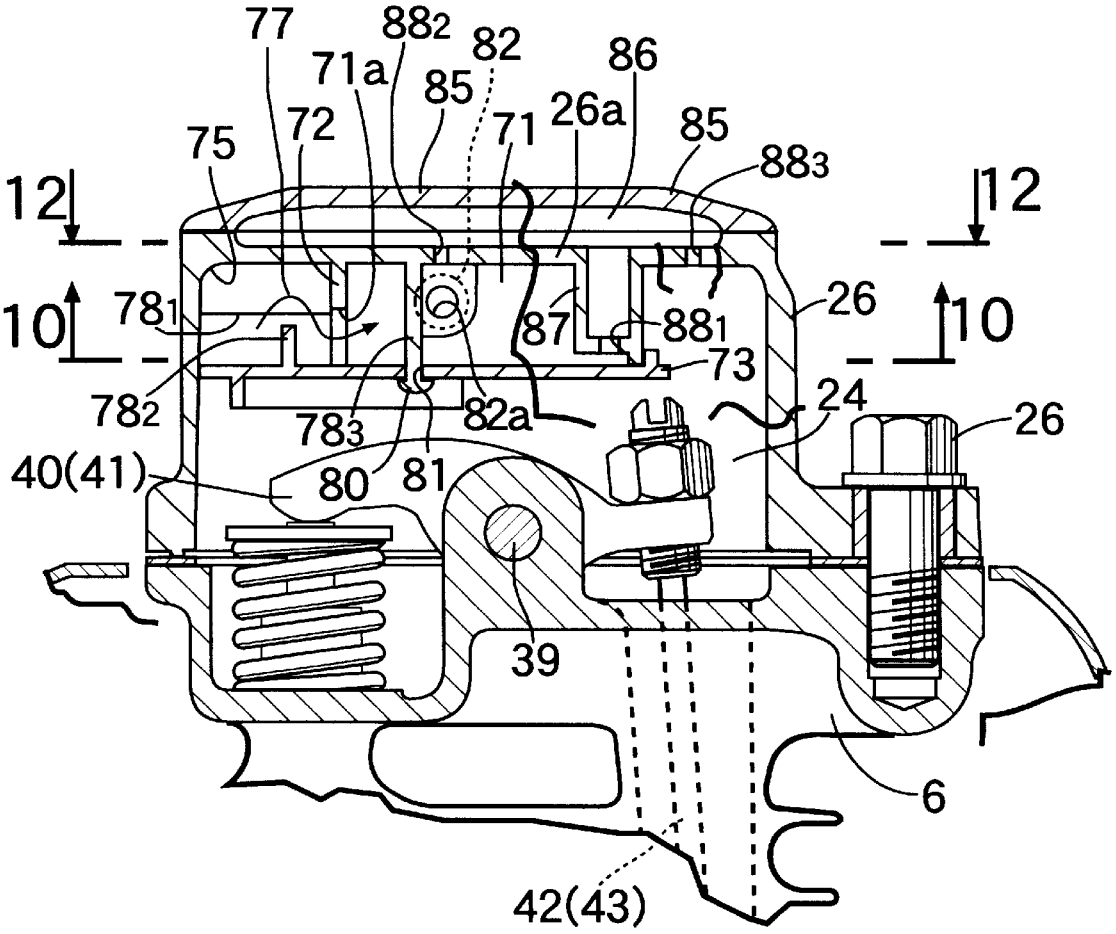
FIG. 9 is an enlarged vertical cross section of an essential portion of FIG. 2.
Figure 10:
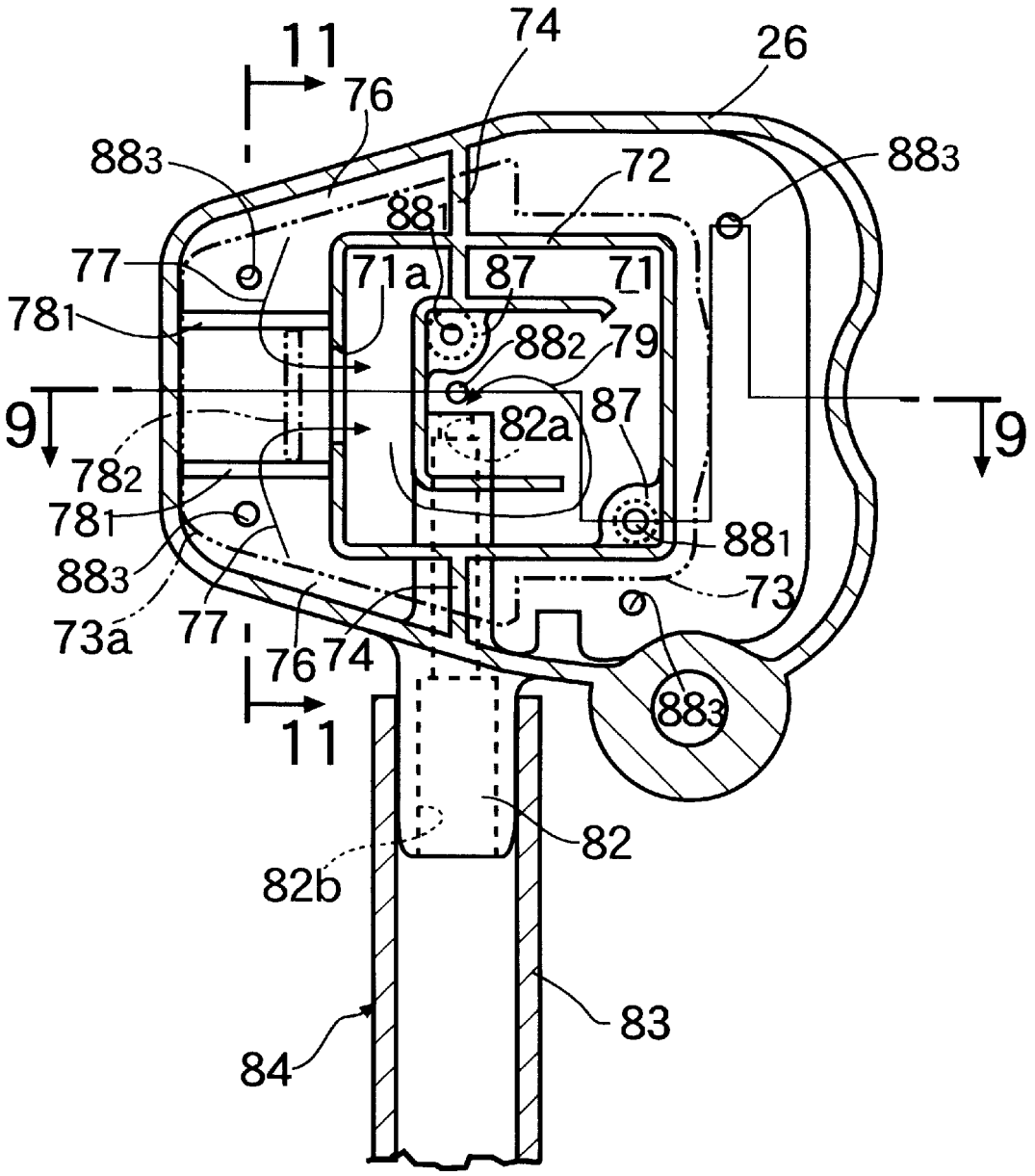
FIG. 10 is a cross section taken along a line 10—10 of FIG. 9.
Figure 11:
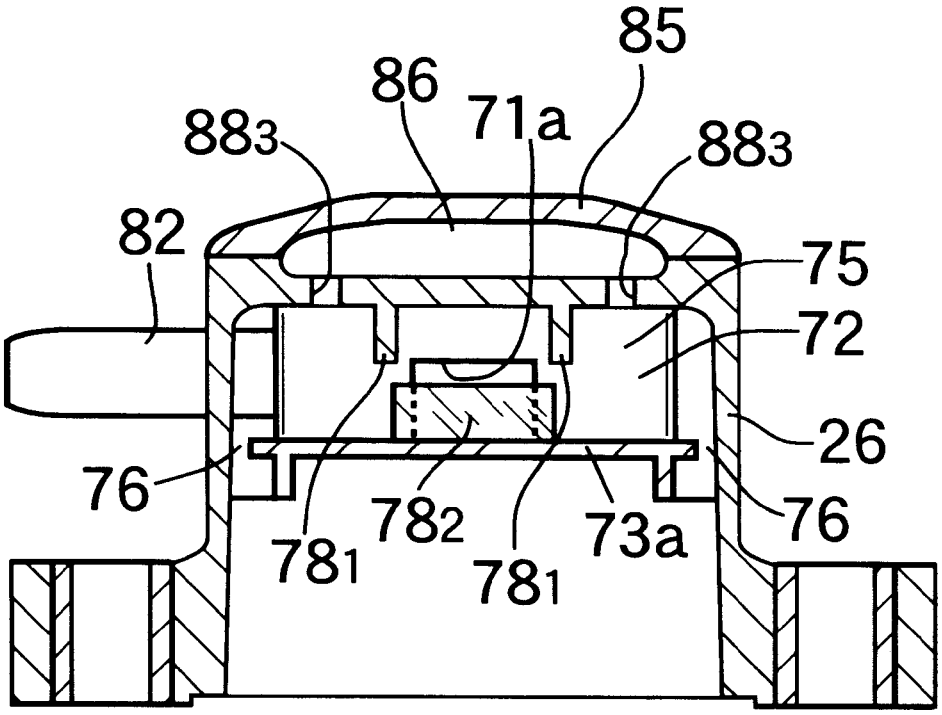
FIG. 11 is a cross section taken along a line 11—11 of FIG. 10.
Figure 12:
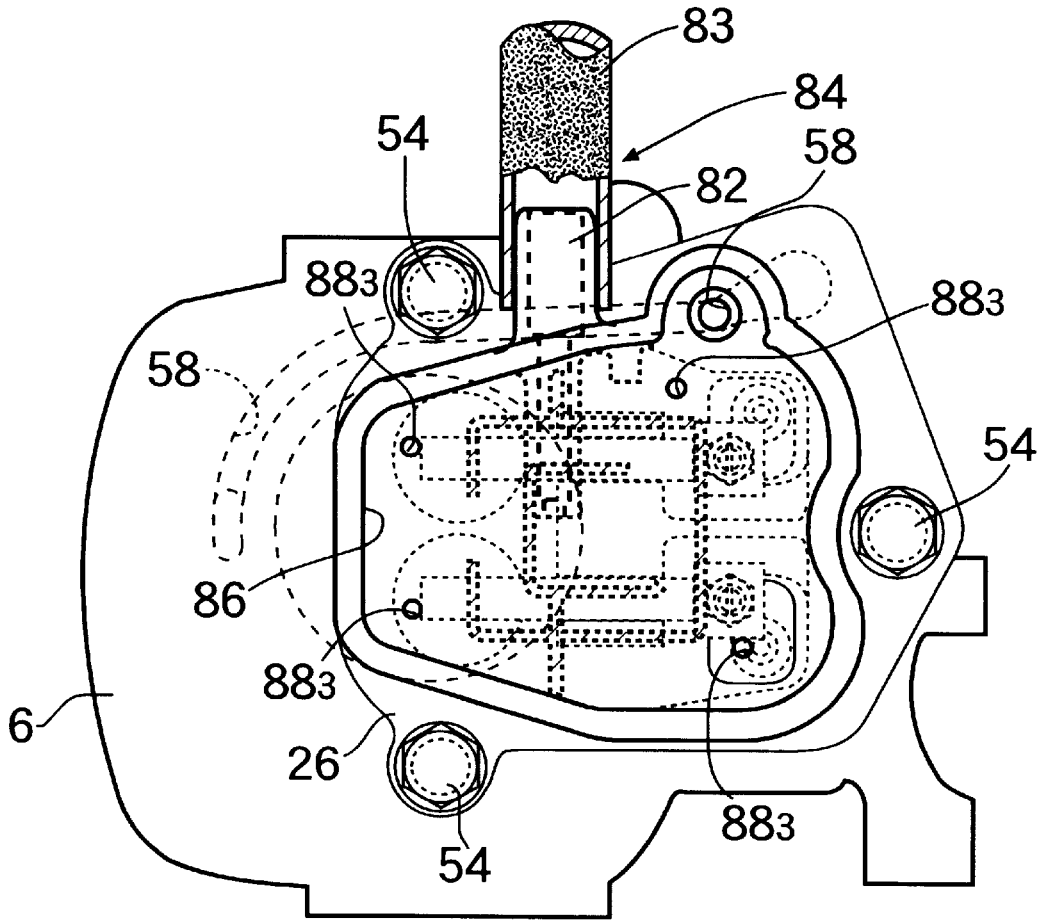
FIG. 12 is a cross section taken along a line 12—12 of FIG. 9.

As shown in FIGS. 2, 6 and 8, the valve operating device 31 comprises a drive timing gear 32 secured to the crankshaft 13, a driven timing gear 33 rotatably supported on a support shaft 34 supported between the jointed surfaces of the cylinder block 6 and the crankcase 7 and driven at a 2:1 gear ratio by the drive timing gear 32, a cam 35 integrally mounted to one end of the driven timing gear 33, a pair of cam followers 37, 38 supported on a cam follower shaft 36 provided in the cylinder block 6 so that they can be oscillated by the cam 35 about the cam follower shaft 36, a pair of rocker arms 40, 41 supported on a rocker arm shaft 39 provided at the head portion of the cylinder block 6 and engaged at one end with valve heads of the intake and exhaust valves 29, 30, a pair of pushrods 42, 43 connecting the cam followers 37, 38 to the other end of the rocker arms 40, 41, and valve springs 44, 45 urging the intake and exhaust valves 29, 30 to close the valve. This valve operating device 31 opens the intake valve 29 during the intake stroke of the piston 8 and opens the exhaust valve 30 during the exhaust stroke.

The oil reservoir chamber 22 and the crankcase chamber 23 communicate with each other through a communication hole 46 cut in the crankshaft 13. An opening of the communication hole 46 opening into the oil reservoir chamber 22 is located at the center of the oil reservoir chamber 22, and the amount of oil O stored in the oil reservoir chamber 22 is set so that the opening end of the hole will not be submerged in the oil whether the engine E is tilted or held upside down.

Figure 7:
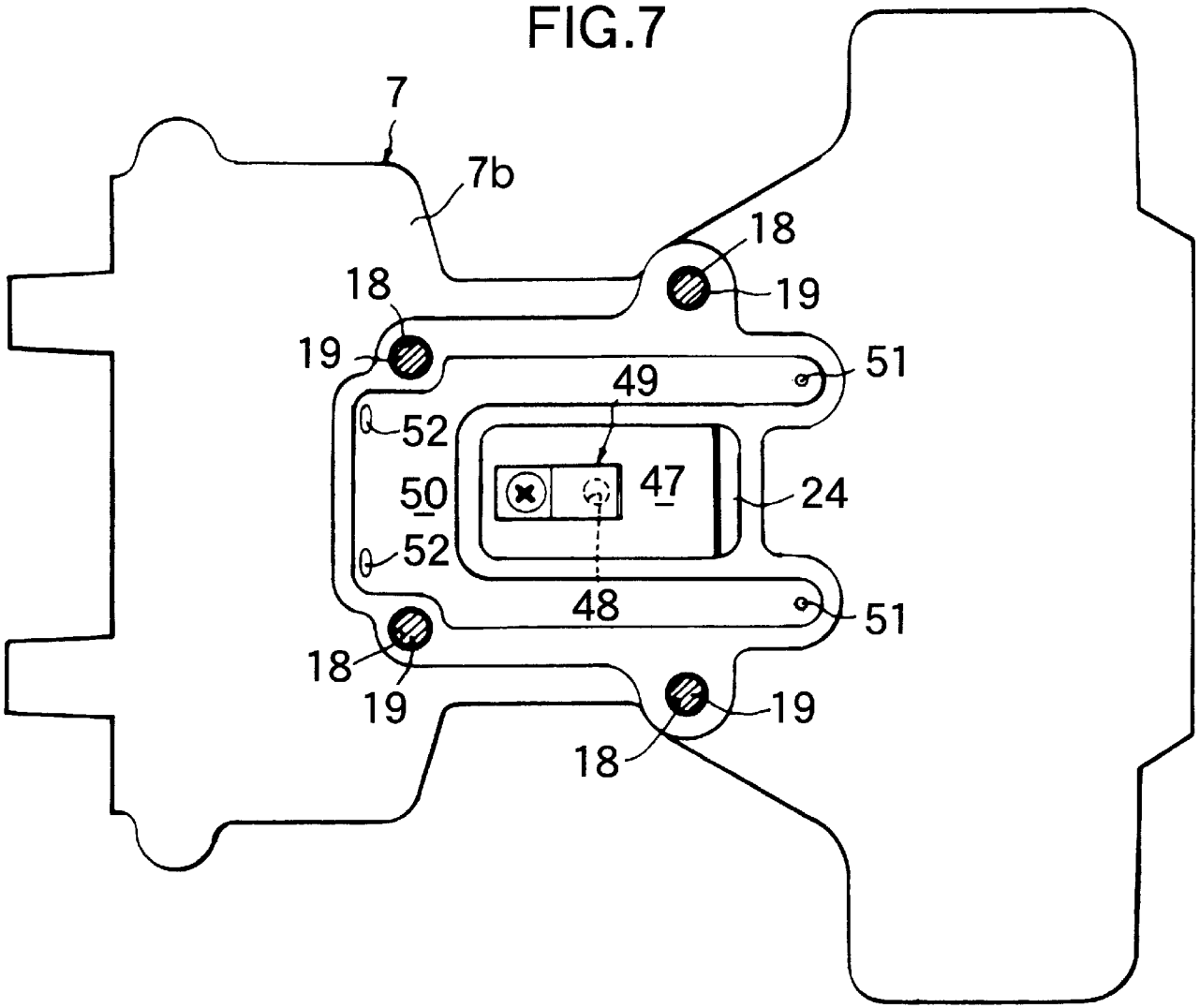

As shown in FIGS. 2 and 7, beneath the crankcase 7 is formed a valve chamber 47 communicating to the valve operation chamber 24 and also to the bottom part of the crankcase chamber 23 through a valve hole 48. In this valve chamber 47 is installed a one-way valve 49 as a control valve that opens and closes the valve hole 48 according to pressure pulsations of the crankcase chamber 23. The one-way valve 49 closes the valve hole 48 when the pressure of the crankcase chamber 23 decreases and opens it when the pressure increases.

Also formed below the crankcase 7 is a U-shaped oil return chamber 50 that encloses the valve chamber 47 as shown in FIG. 7. The oil return chamber 50 communicates with the bottom part of the valve operation chamber 24 through a pair of small holes 51 that are disposed separately as far as possible from each other, on the other hand, communicates with the oil reservoir chamber 22 through a pair of communication holes 52. The total cross-sectional area of the communication holes 52 is set sufficiently larger than that of the small holes 51.

The valve chamber 47 and the oil return chamber 50 are formed by closing a recess on the under surface of the crankcase 7 with a bottom plate 53. The bottom plate 53 is fastened to the crankcase 7 by the stud bolts 19 and nuts 20.

As shown in FIGS. 9 to 12, the head cover 26 has formed therein a gas-liquid separation chamber 71 into which blow-by gases are introduced. The gas-liquid separation chamber 71 is defined by a square enclosing wall 72 integrally projecting from the inner surface of a ceiling wall 26*a* of the head cover 26 made of synthetic resin and by an inner cover 73 of synthetic resin that covers the entire surface of the bottom of the enclosing wall 72. One side portion of the enclosing wall 72 is formed with a notch-shaped inlet 71*a* for the gas-liquid separation chamber 71. Two side portions of the enclosing wall 72 adjoining the one side portion are integrally connected to the inner surface of the circumferential wall of the head cover 26 through reinforcing ribs 74. The reinforcing ribs 74 and the circumferential wall half of the head cover 26 together define an inlet chamber 75 into which the inlet 71*a* opens. An integral extension portion 73*a* is defined integrally on the inner cover 73, which covers the surface of the bottom of the inlet chamber 75. The extension portion 73*a* abuts against the inner part of the circumferential wall of the head cover 26 opposed to the inlet 71*a*. On both sides of this engaged part of the wall air vent gaps 76 are formed between the wall and the extension portion 73*a*. First winding paths 77 extending from the air vent gaps 76 to the inlet 71*a* are formed in the inlet chamber 75. The first winding paths 77 are formed by a pair of first obstruction walls $\mathbf{78}_1$ integrally protruding from the inner surface of the ceiling wall 26*a* of the head cover 26 and disposed on both sides of the inlet 71*a* and by a second obstruction wall $\mathbf{78}_2$ rising from the upper surface of the inner cover 73 and facing the inlet 71*a*. These first and second obstruction walls $\mathbf{78}_1$, $\mathbf{78}_2$ are of course set lower in height than the enclosing wall 72 to allow the passage of blow-by gases.

In the gas-liquid separation chamber 71 there is installed a third obstruction wall $\mathbf{78}_3$ that is angularly U-shaped in cross section and integrally projecting from the inner surface of the ceiling wall 26*a* of the head cover 26, with its open portion directed in an opposite direction of the inlet 71*a*. The lower end of the third obstruction wall $\mathbf{78}_3$ abuts the inner cover 73, and a plurality of locking projections 80 formed at the lower ends of the third obstruction wall $\mathbf{78}_3$ and the enclosing wall 72 are inserted through locking holes 81 of the inner cover 73 and then fused and caulked to secure the inner cover 73 to the enclosing wall 72 and the third obstruction wall $\mathbf{78}_3$.

The head cover 26, the inner cover 73 and the third obstruction wall $\mathbf{78}_3$ are formed integrally with a breather outlet tube 82 that extends through their side walls. The breather outlet tube 82 has an inner end tube 82*a* projecting into and opening into the third obstruction wall $\mathbf{78}_3$ at a height corresponding to a central part of the gas-liquid separation chamber 71 and also an outer end tube 82*b* projecting to the outside of the head cover 26. The outer end tube 82*b* is connected with a rubber breather tube 83 that opens into the air cleaner 4. The breather outlet tube 82 and the breather tube 83 together form a breather passage 84. The third obstruction wall $\mathbf{78}_3$ forms a second winding path 79 between the inlet 71*a* of the gas-liquid separation chamber 71 and the breather outlet tube 82.

An outer cover 85 of synthetic resin is fused to the outer surface of the ceiling wall 26*a* of the head cover 26 to form a flat suction chamber 86. A plurality of suction tubes 87 (two in the example shown) communicating to the suction chamber 86 are formed integrally with the ceiling wall 26*a* of the head cover 26 and located at inner opposite corners of the enclosing wall 72 and the third obstruction wall $\mathbf{78}_3$. These suction tubes 87 are provided at their lower end with a first oil suction hole 881 facing the upper surface of the inner cover 73 with a small clearance therebetween. The ceiling wall 26*a* of the gas-liquid separation chamber 71 is formed with one or more second oil suction holes $\mathbf{88}_2$ reaching the suction chamber 86. The gas-liquid separation chamber 71 therefore has the first and second oil suction holes $\mathbf{88}_1$, $\mathbf{88}_2$ above and below the inner end tube 82*a* of the breather passage 84.

Further, the ceiling wall 26*a* of the head cover 26 is formed with third oil suction holes $\mathbf{88}_3$ at four corners around the gas-liquid separation chamber 71 that reach the suction chamber 86. The opening areas of the first, second and third oil suction holes $\mathbf{88}_1$, $\mathbf{88}_2$ and $\mathbf{88}_3$ are set smaller than that of the inner end tube 82*a* of the breather passage 84.

The suction chamber 86 communicates to the oil return chamber 50 through an oil passage 58 formed in the cylinder block 6 and the crankcase 7. The oil passage 58 has a larger cross-sectional area than the total cross-sectional area of the first, second and third oil suction holes $\mathbf{88}_1$, $\mathbf{88}_2$ and $\mathbf{88}_3$.

During the operation of the engine E, the pressure of the crankcase chamber 23 pulsates to a positive and a negative pressure alternately due to vertical reciprocating motion of a piston 5. When the pressure of the crankcase chamber 23 is positive, the one-way valve 49 opens to release the positive pressure to the valve chamber 47 side. When the pressure of the crankcase chamber is negative, the one-way valve 49 closes to block the backflow of the positive pressure from the valve chamber 47. The pressure in the crankcase chamber 23 is therefore kept at a negative pressure on average.

The valve chamber 47, the valve operation chamber 24 and the gas-liquid separation chamber 71, which are interconnected with each other, communicate through the breather tube 83 to the interior of the air cleaner 4 with an atmospheric pressure. Thus, these three chambers 47, 24, 71 have pressures substantially equal to the atmosphere.

Since the oil reservoir chamber 22 communicates with the crankcase chamber 23 through the communication hole 46, a pressure of the oil reservoir chamber 22 is equal to or slightly higher than the pressure of the crankcase chamber 23.

Since the oil return chamber 50 communicates to the oil reservoir chamber 22 via the communication holes 52 and also to the valve operation chamber 24 via the small holes 51, the pressure of the oil return chamber 50 is equal to or slightly higher than the oil reservoir chamber 22.

The suction chamber 86 communicates to the oil return chamber 50 through the oil passage 58 and also to the valve operation chamber 24 through the first, second and third oil suction holes $\mathbf{88}_1$, $\mathbf{88}_2$ and $\mathbf{88}_3$. The pressure of the uppermost level chamber 50 is therefore equal to or slightly higher than that of the oil return chamber 22.

The pressure relationship among these chambers can be expressed as follows.

$$Pc \leqq Po \leqq Pr \leqq Pt < Pv$$

where Pc is a pressure in the crankcase chamber 23, Po is a pressure in the oil reservoir chamber 22, Pr is a pressure of the oil return chamber 50, Pt is a pressure of the suction chamber 86, and Pv is a pressure of the valve operation chamber 24.

During engine operation, therefore, the oil pressure flows in the following route.

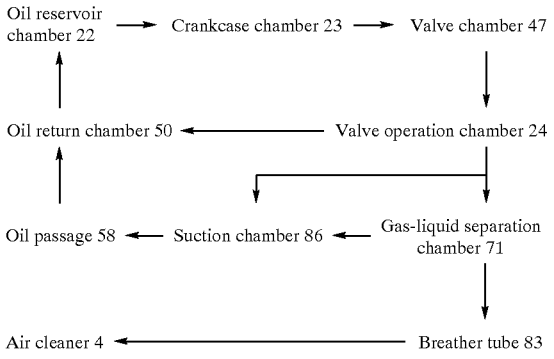

When the rotation of the crankshaft 13 causes the oil slinger 25 to agitate the lubricating oil O in the oil reservoir chamber 22, oil mist is produced and taken into the crankcase chamber 23 through the communication hole 46 by suction to lubricate the crank portion 13*a*, the piston 8 and surrounding thereof. The oil mist is then moved along with blow-by gases generated in the crankcase chamber 23 from the valve hole 48 of the one-way valve 49 to the valve chamber 47 and accordingly to the valve operation chamber 24, where it lubricates each part of the valve operating device 31.

The oil mist and blow-by gas then flow through the air vent gaps 76 between the inner wall of the head cover 26 and the extension portion 73*a* of the inner cover 73 and into the first winding paths 77, where they are separated into gas and liquid. The separated oil falls flowing from the small holes 51 in the bottom of the valve operation chamber 24 into the oil return chamber 50, from which it is further returned to the oil reservoir chamber 22.

The blow-by gas carrying some oil mist that has flowed past the first winding paths 77 now enters the gas-liquid separation chamber 71 from its inlet 71*a* and, while moving through the second winding path 79, is separated into gas and liquid. The blow-by gas removed of oil flows through the breather passage 84 out into the air cleaner 4. When the oil separated in the gas-liquid separation chamber 71 is accumulated to some degree at the bottom of the chamber, it is drawn from the first oil suction holes $\mathbf{88}_1$ through the suction tubes 87 into the suction chamber 86, from which it is returned through the oil passage 58 to the oil return chamber 50 and to the oil reservoir chamber 22.

Even when the engine E is operated in an inverted attitude, the oil mist can be produced to lubricate parts as when it is in a normal upright position.

In this inverted position, the suction chamber 86 is situated at the lowermost level of the engine E, so that the oil liquefied in the valve operation chamber 24 remains on the ceiling wall 26*a* of the chamber 24 and is drawn through the third oil suction holes $\mathbf{88}_3$ into the suction chamber 86. At this time, since the third oil suction holes $\mathbf{88}_3$ are provided at four corners of the ceiling wall 26*a*, at least one of the third oil suction holes $\mathbf{88}_3$ is submerged in the oil collected on the ceiling wall 26*a*, in whichever direction the engine E is tilted. Thus, the oil can reliably be drawn into the suction chamber 86. The oil liquefied in the gas-liquid separation chamber 71 remains on the ceiling wall 26*a* of the chamber 71 and is drawn into the second oil suction holes $\mathbf{88}_2$. The oil that was drawn into the suction chamber 86 is returned through the oil passage 58 to the oil return chamber 50 and the oil reservoir chamber 22, as described above.

The blow-by gas removed of oil flows through the breather passage 84 out into the air cleaner 4 as in the previous case.

In this way, even when the engine E is held upside down, the oil mist lubricates the engine parts and the oil mist and blow-by gas are separated into gas and liquid, and then the separated oil can be returned to the oil reservoir chamber 22 and the blow-by gas to the air cleaner 4. This means that the power trimmer T can tolerate operations in any attitude or direction. Further, since the circulation of lubricating oil utilizes the pressure pulsations of the crankcase chamber 23, an expensive oil pump is not needed.

Returning again to FIG. 2, the outer end portion of the crankshaft 13 on the valve operation chamber 24 is securely fitted with a rotor 61 with cooling vanes 60 of a flywheel magneto 59. An ignition coil 62 cooperating with the rotor 61 is secured to the cylinder block 6. A centrifugal clutch 64 is interposed between the rotor 61 and a drive shaft 63 for the working machine. The centrifugal clutch 64 comprises a plurality of clutch shoes 65 supported on the rotor 61 so that their diameter can be expanded, a clutch spring 66 urging the clutch shoes to reduce their diameter, and a clutch drum 67 enclosing the clutch shoes 65 and secured to the drive shaft 63. When the rotor 61 rotates at a speed equal to or greater than a predetermined revolution, the clutch shoes 65 expand their diameter to press against the inner circumferential surface of the clutch drum 67, thereby transmitting the output torque of the crankshaft 13 to the drive shaft 63.

The engine body 1 is mounted with a shroud 69 that encloses the head portion of the engine body 1 and the flywheel magneto 59, and which also defines a cooling air passage 68 between the engine body 1 and the flywheel magneto. Between the centrifugal clutch 64 and the shroud 69 a ring-shaped inlet 68*i* of the cooling air passage 68 is provided. The shroud 69 has an outlet 68*o* on the opposite side thereof.

When the rotor 61 is rotating, the wind generated by the cooling blades 60 flows through the cooling air passage 68 to cool respective parts of the engine E.

Mounted on the outer side of the crankcase 7 on the oil reservoir chamber 22 side is a known recoil type starter 70 that can crank the crankshaft 13. This starter 70 is arranged to project from the outer surface of the shroud 69 from the standpoint of operability. Since this starter 70 is arranged on the outside of and adjacent to the oil reservoir chamber 22, no dead space is formed on the inner side of the starter 70, contributing to a reduction in the size of the engine E.

This invention is not limited to the above embodiment and various design modifications may be made without departing from the spirit and scope of this invention. For example, the one-way valve 49 may be replaced with a rotary valve that is interlocked with the rotation of the crankshaft 13. Further, the enclosing wall 72 and the inner cover 73 may be formed integrally. The breather passage 84 may also be open to the atmosphere.

We claim:

1. A breather device for an engine, comprising:

a gas-liquid separation chamber communicating with a crankcase chamber in an engine;

a control valve installed in a communicating passage between the crankcase chamber and the gas-liquid separation chamber to pass positive pulsating pressures generated in the crankcase chamber;

a breather passage to opening the gas-liquid separation chamber to an intake system of the engine or to the atmosphere;

first and second oil suction holes arranged respectively below and above an inner end of the breather passage which opens into the gas-liquid separation chamber; and an oil passage communicating the first and second oil suction holes to an oil reservoir chamber having a pressure lower than that of the gas-liquid separation chamber.

2. A breather device for an engine according to claim 1, wherein a winding path is formed between an inlet of the gas-liquid separation chamber and the breather passage.

3. A breather device for an engine according to claim 1 or 2, wherein a suction chamber communicating with said oil passage is formed above the gas-liquid separation chamber with a separation wall interposed therebetween, the separation wall is formed with a suction tube communicating with the suction chamber, the first oil suction hole formed at a lower end of the suction tube is set close to a bottom wall of the gas-liquid separation chamber, and the second oil suction hole communicating the gas-liquid separation chamber and the suction chamber with each other is formed in the separation wall.

4. A breather device for an engine according to claim 1, or 2 wherein a valve operation chamber communicating with the crankcase chamber through the control valve is formed at a bottom wall thereof, with small holes communicating with the oil reservoir chamber, and a ceiling portion of the valve operation chamber is formed with the gas-liquid separation chamber communicating with the valve operation chamber and also formed with a third oil suction hole communicating with the oil passage.

5. A breather device for an engine according to claim 4, wherein the valve operation chamber is formed with a winding path communicating the valve operation chamber to an inlet of the gas-liquid separation chamber.

* * * * *